United States Patent [19]

Quadracci

[11] Patent Number: 5,029,830

[45] Date of Patent: Jul. 9, 1991

[54] APPARATUS AND METHOD FOR CUSTOMIZING MAGAZINES

[75] Inventor: Thomas A. Quadracci, Brookfield, Wis.

[73] Assignee: Quad/Tech, Inc., Pewaukee, Wis.

[21] Appl. No.: 409,153

[22] Filed: Sep. 19, 1989

[51] Int. Cl.[5] ..... B65H 39/00

[52] U.S. Cl. ..... 270/52; 270/54; 270/55

[58] Field of Search ..... 270/1.1, 52, 53, 54, 270/55, 57, 58; 198/570, 644, 363

[56] References Cited

U.S. PATENT DOCUMENTS

| | | | |
|---|---|---|---|
| 3,661,379 | 5/1972 | Dolfini | 270/54 |
| 3,819,173 | 6/1974 | Anderson et al. | 270/54 |
| 3,982,744 | 9/1976 | Kraynak et al. | 270/54 X |
| 4,022,455 | 5/1977 | Newsome et al. | 270/54 |
| 4,121,818 | 10/1978 | Riley et al. | 270/54 |
| 4,395,031 | 7/1983 | Gruber et al. | 270/54 |
| 4,395,147 | 7/1983 | Gerber et al. | 270/55 X |
| 4,789,147 | 12/1988 | Berger et al. | 270/1.1 |

FOREIGN PATENT DOCUMENTS

| | | | |
|---|---|---|---|
| 2104493 | 3/1983 | United Kingdom | 270/1.1 |

*Primary Examiner*—John T. Kwon
*Assistant Examiner*—Todd Mattingly
*Attorney, Agent, or Firm*—Foley & Lardner

[57] ABSTRACT

A customizing system for signatures delivered by signature feeders to a conveyor includes a variable selection device comprising a plurality of vanes, each of which has elongated guide members extending to the signature feeders and a switchplate selectively alignable with the vanes and cooperable with the guide members to define an extended travel path over which a signature selected from the feeders may be customized.

11 Claims, 4 Drawing Sheets

APPARATUS AND METHOD FOR CUSTOMIZING MAGAZINES

TECHNICAL FIELD

The present invention relates generally to an apparatus and method for customizing signatures assembled into booklet or magazine form and, more particularly, to an apparatus and method of providing variable personalized information in a variety of locations upon the signatures being assembled.

BACKGROUND OF THE INVENTION

Collating and binding systems for saddle stitchers are well known in the printing industry for mass producing booklets, magazines, catalogues, advertising brochures and the like. Typically, one or more sharply folded and generally pre-printed blanks or signatures are selectively and sequentially fed by a number of spaced signature feeders. The signatures are delivered such that the folded margins or spines of the signatures come to rest upon a collating conveyor line or chain which travels past the signature feeders. The conveyor gathers the signatures, one on top of the other, and moves them, through one or more on-line printing stations, to a stitching or binding station. The assembled signatures then are usually diverted to a trimming station and further led to a labeling station where mailing labels which are pre-printed or printed on-line are affixed.

Prior art systems of this type contemplate the computer controlled production of various demographic editions of books or catalogues of internal and external signatures containing individually tailored information or customized printing on selected signatures. This flexibility is important in satisfying the demands of a particular market or geographical destination. For instance, it may be desirable to offer certain customers or subscribers various features or selected advertising depending upon their special interest, income or occupation. Likewise, it may be relevant to customize products or services contingent upon a customer,s previous buying history. For example, a publication may issue one demo edition for parents of newborn children who have purchased baby products, another edition for farmers interested in the latest milking machines and still another edition for recent purchasers of exercise equipment. In each situation, a publisher may utilize various modes of customization such as blown-in card feeding, invoicing, advertising material insertion, renewal notices and tipping, as well as several types of contact or contactless printing.

To provide these demographic versions, the prior art commonly employs an information source which indicates the special interest of each subscriber within a common postal locale. Based on the information source, a controller selectively actuates the signature feeders to deliver certain signatures upon the conveyor to form one or more individualized editions of a booklet or magazine for each subscriber within the zip code area. Information in the source is generally arranged in sequential order so that the formed booklets or magazines leave the conveyor ready to be sorted into groups which qualify for postal rate discounts. As part of the collation process, the signatures are conveyed past one or more customizing stations typically including a label head, card inserter, and/or dot matrix ink jet print heads mounted in predetermined relation to a support for the signatures. Examples of such systems are described in U.S. Pat. Nos. 3,819,173 issued June 25, 1974 to Anderson et.al., and 4,121,818 issued Oct. 24, 1978 to Riley et.al.

In some instances, a mechanism for disposing a particular signature for personalization is also provided. One example of this type of demographic bindery system is disclosed in U.S. Pat. No. 4,395,031 issued to Gruber et.al. on July 26, 1983. In this arrangement, a plate-like member downstream of the conveyor cooperates with the conveyor chain and an elongated guide member (wire) extending between a signature feeder and the plate-like member to move a page out of superpositioned relationship with a signature delivered to the conveyor just prior to delivery of the selected signature. This opens the books of signatures at the signature selected for opening by the guide member to expose an inside page or internal signature for personalization by a dot matrix printer. Various combinations of plate-like members, guide members, and printers are disclosed to enable customized printing of various internal and external signatures in a book being collated.

It is desirable that magazines be packaged to take maximum advantage of postal discounts. For example, bundles of six or more magazines to be sent by second class mail to subscribers having a common 3-digit zipcode prefix are entitled only to the basic or highest postal rate. However, a bundled group of six or more magazines sent to subscribers having a common 5-digit zipcode obtains a more favorable intermediate postal rate, and grouping six or more magazines sent to subscribers along the same carrier route, qualifies for a lower still postal rate. Accordingly, it is desirable that a bindery build magazines in an order that facilitates presorting and packaging to maximize postal discounts. In this regard, it would be advantageous in some instances if a plurality of different types of magazines could be built during a given production run, to facilitate grouping the various magazines destined for a given carrier route.

Prior art systems are disadvantageous primarily because of inflexibility. For example, even though books may be opened at several internal positions, customization is limited since each book being assembled must be opened at the same fixed pages as dictated by the initial setup of the guide wires and plate-like members. As a result, there is little variance in the type of magazines or books formed during a production run for a given postal zone. Each time a change in the location of customized information is desired, the connection between the plate-like member and signature feeder must be manually reset, restrung at the right position on the plate-like member and with the proper tension to ensure that signatures selected to travel upon the guide wires will do so smoothly without jamming or colliding with other elements of the system. Additional techniques of customizing selected signatures beyond the realm of conventional ink jet printing need to be considered.

Accordingly, it is desirable that the demographic bindery system offer a greater degree of customization, improving upon the selectivity of the signatures to be personalized, and permit totally different magazines to be assembled during a single production run for subscribers in a given postal zone irrespective of varying points of customization.

SUMMARY OF THE INVENTION

The present invention advantageously provides an improved customizing capability for high speed demographic collators and binders. The improved system is particularly versatile and is readily retrofit into existing systems.

These and other advantages are realized, in one aspect of the invention by a system having feeders for selectively delivering signatures to a conveyor to progressively form books of signatures and an opening device cooperating with a signature selector to open each book at a selected signature to be customized, the system being improved with a controller for controllably selecting a signature on a book-by-book basis.

The present invention also relates to a method for customizing signatures being assembled on a collating and binding line including the step of variably selecting a signature for each book formed, independent of a signature previously selected.

In a highly preferred embodiment, the invention contemplates a plurality of vanes, each of which has elongated guide members secured thereto extending to various locations on the signature feeders. A switchplate is selectively aligned with the vanes to define an extended travel path over which a signature selected from the feeders may be delivered to be customized.

BRIEF DESCRIPTION OF THE DRAWING

The invention will become better understood by reference to the following detailed description of the preferred exemplary embodiment when read in conjunction with the appended drawing wherein like numerals denote like elements and.

DETAILED DESCRIPTION OF THE PREFERRED EMBODIMENT

Figure 1:
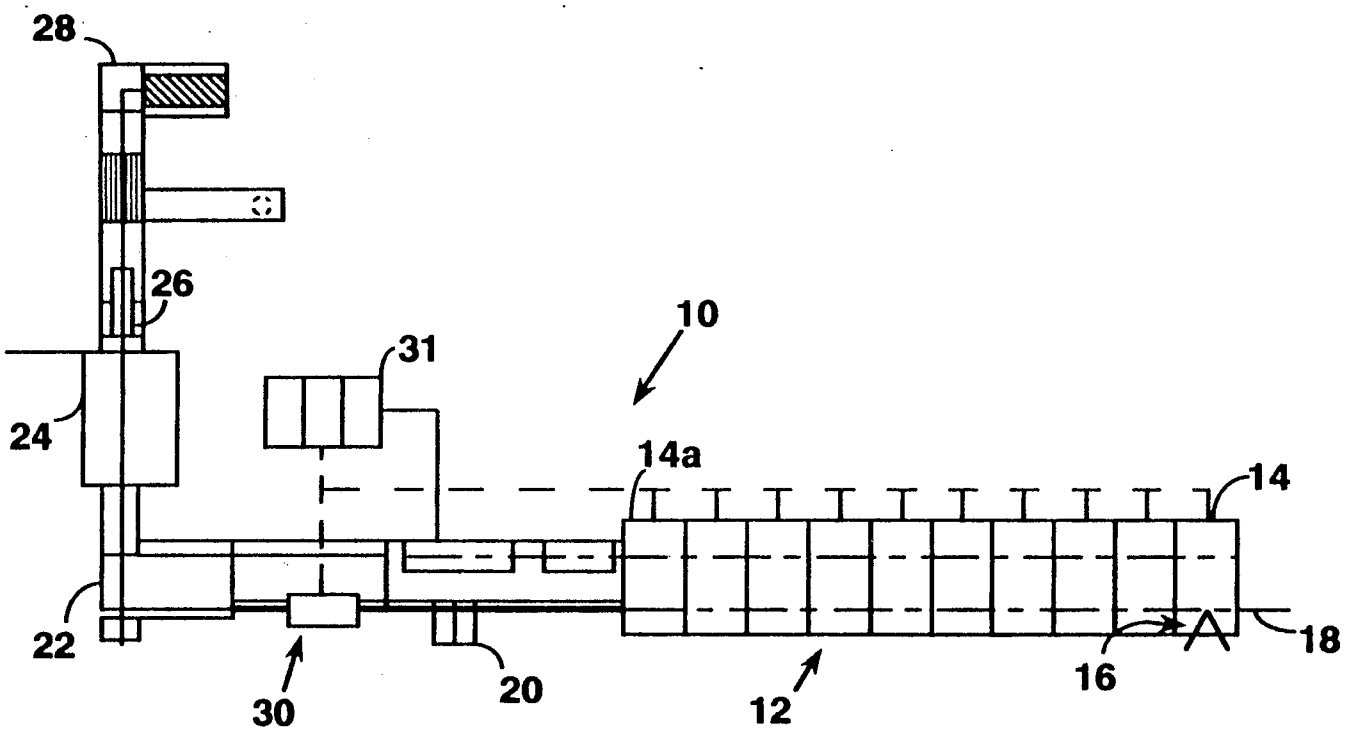
FIG. 1 is a schematic block diagram of a collating and binding system employing the present invention.

Referring to FIG. 1, a collation and binding system 10 for a saddle stitcher encompassed by the present invention is employed to produce various magazines, catalogues, brochures, periodicals, etc. containing different collections of signatures for different customers or subscribers. System 10 suitably comprises an inserter 12 having a plurality of signature feeders, (boxes) 14, a collating chain (conveyor) 18, a caliper 20, a stitcher 22, a trimmer 24, a labeling station 26, and a stacker 28.

Each feeder 14 holds a supply of signatures 16, and is designed to selectively deliver a singular signature 16 from a supply stack within the feeder 14. Collating chain or conveyor 18 collects signatures 16 from signature feeders 14 and transports the signatures downstream along a collation and binding line. As signatures 16 are gathered, they move past caliper 20, which monitors the appropriate thickness of the book (signature collection) and then travel through one or more customizing systems 30 which, in accordance with the present invention, operate to variably select and customize signatures being collated. After the customizing, conveyor 18 pushes the signatures to stitcher 22 where they are bound, to create an assembled book such as by stapling or the like.

The assembled book is then diverted onto another conveyor to trimmer 24 where its edges are trimmed and labeling station 26 where a human readable mailing label is printed or otherwise applied. Thereafter, the assembled books may be conveyed to stacker 28 and readied for mail or other distribution.

The collating and binding system generally described above is controlled by a conventional computer or programmable controller 31, the details of which are well known in the art except with respect to certain qualifications as will be hereafter explained. Likewise, the inserter 12, caliper 20, stitcher 22, trimmer 24, labeling station 26, and stacker 28 are of conventional construction and do not require a detailed discussion. Controller 31 is operatively connected to feeders 14 of inserter 12 and to customizing system 30, and provides control signals thereto. While not absolutely necessary, it is common practice to mount caliper 20 adjacent conveyor 18 to measure the thickness of the books of signatures being collated upon their departure from the last feeder 14*a* Caliper 20 sends an interrupt signal to controller 31 upon deviation from a prescribed thickness parameter.

Figure 2:
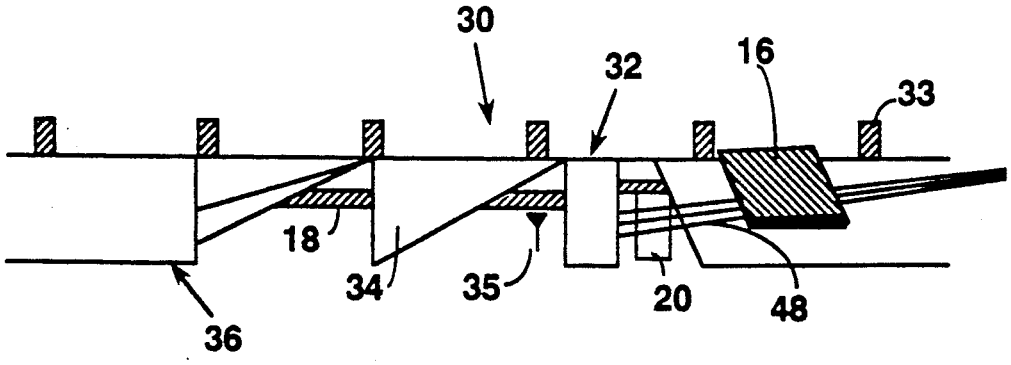
FIG. 2 is an enlarged, fragmentary front view of the signature selection and customizing apparatus shown in FIG. 1.
Figure 4:
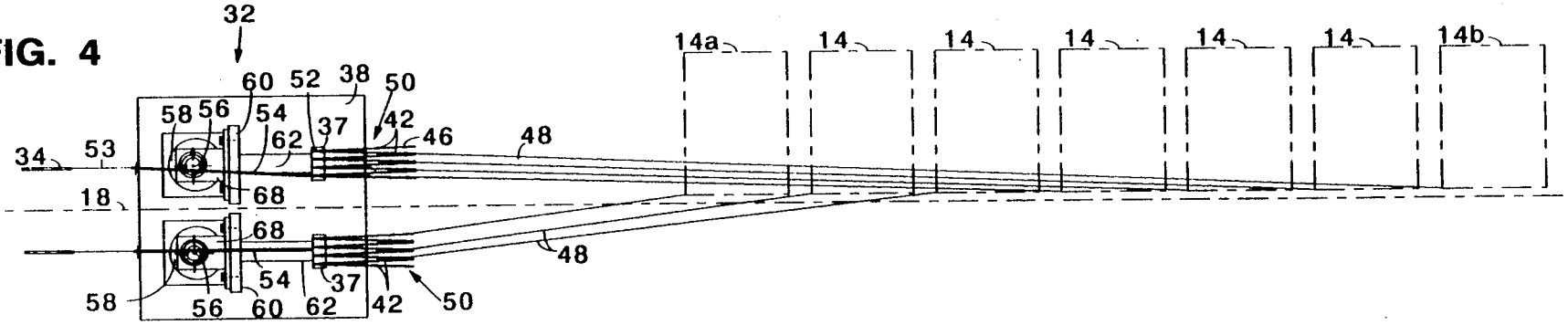
FIG. 4 is a top view of the signature selection apparatus shown in FIG. 3.
Figure 3:
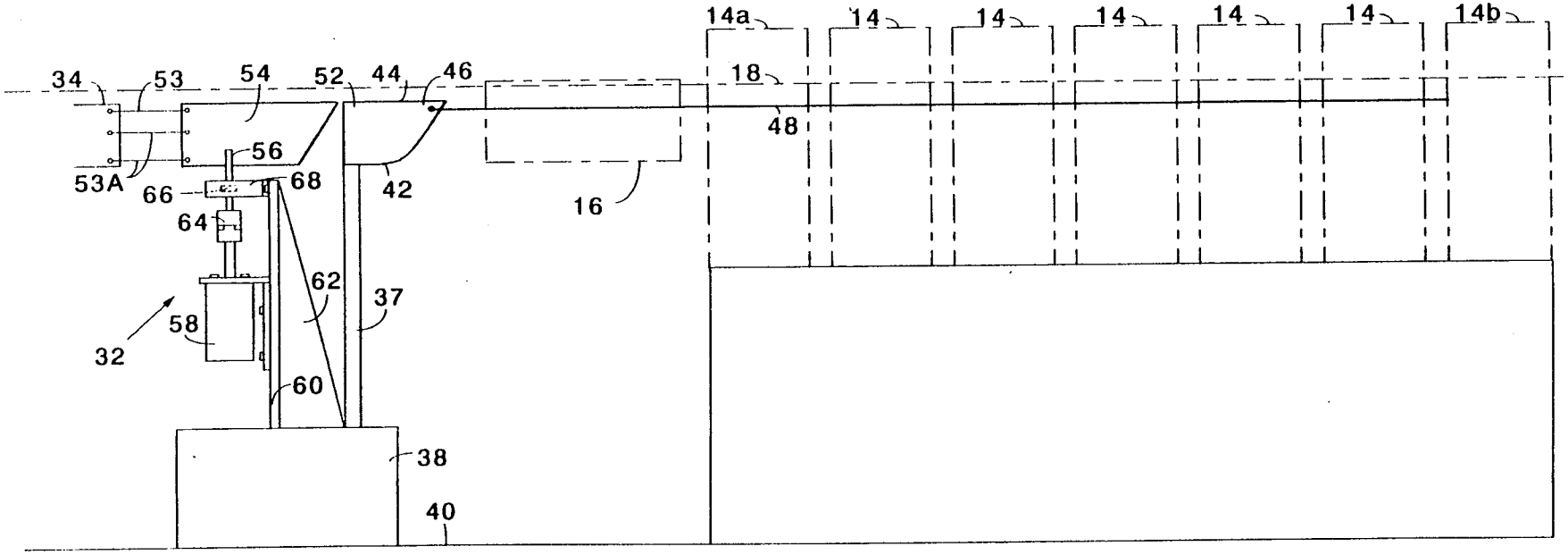
FIG. 3 is an enlarged, fragmentary view of the signature selection apparatus shown in FIG. 2.

Turning now to FIGS. 2–4, customizing system 30 is generally disposed downstream of the last signature feeder 14*a*, and is adapted to operate upon collated signatures 16 maintained in custody on conveyor 18 in a product slot (station) defined by upstanding lugs 33. As is well known, lugs 33 may be monitored by a detector 35 to enable controller 31 to keep inventory of the books being formed in accordance with the movement of conveyor 18.

A customizing system 30 embodying the present invention suitably comprises a signature selector 32 cooperating with a signature support 34 and a customizing unit 36. Unit 36 may take the form of a printer, blow-in card feeder and/or applique device such as conventionally utilized in a demographic binding line. In the preferred embodiment, a printer of the well known dot matrix ink jet type is utilized, but it should be understood that other types of contact and contactless printers may also be employed. Likewise, other suitable devices, such as, for example a blow-in card feeder, or the like, may be employed in conjunction with or in place of a printer as will be understood.

Signature selector 32 responsive to signals from controller 31, selects a particular signature 16 from one of the feeders 14 designated by controller 31, at which signature personalized information may be applied. As best seen in FIGS. 3 and 4, signature selector 32 suitably comprises a pair of upstanding support members 37, base 38, a plurality of vanes 42, guide members 48 and movable switchplates 54. Support members 37 are anchored upon base 38 (resting on the floor 40). At the upper end of each support member 37, vanes 42 are rigidly mounted. Each of vanes 42 extend in flag-like fashion, parallel to each other and include top portions 44 which lie parallel to and at a slightly lesser elevation than conveyor chain 18. Each vane 42 has an upstream end 46 to which is attached elongated guide member 48 (e.g., wire) which extends upstream of the conveyor 18 to a point on an associated one of signature feeders 14;

each vane 42 is discretely connected to an associated one of feeders 14 via a separate wire 48. Signatures fed from the associated feeder 14, are deposited on conveyor 18 with one flap overlying wire 48.

The flaps of signatures delivered onto conveyor 18 downstream of such wire 48 will be transported over the wire 48. Signatures 16 delivered onto conveyor 18 upstream of such wire 48 will have flaps carried under wire 48. Each wire 48 defines an obstruction free path extending downstream along the conveyor chain 18 to customizing system 30 over which a signature 16 selected from the associated feeder 14 may travel. In the preferred embodiment, vanes 42 are grouped in two banks 50, each being spaced on opposite sides of and equidistant from the conveyor 18, to properly distribute wires 48 therealong. The longer wires 48 are disposed to the outside of each bank 50 relative to conveyor chain 18 to prevent hangups.

Signature selector 32 is operatively connected with controller 31 to effectively select a signature 16 to be opened upon signature support 34. The downstream end 52 of each vane 42 in each bank 50 is variably placed in communication with movable switchplate 54. Each switchplate 54 is mounted for limited pivotal movement on a rotatable shaft 56 extending from a motor 58 which in turn is anchored to a support plate 60 reinforced by a triangular brace 62 on base 38. To ensure stability, shaft 56 passes first through a coupling 64 and then through a bearing 66 seated in a support arm 68 projecting from plate 60 before its attachment to switchplate 54. The downstream side of plate 54 is connected to signature support 34 by at least one flexible auxiliary line 53, preferably running from the upper downstream corner of plate 54 to the forward upper corner of support 34. Additional lines 53A may also be provided for additional strength.

As will be further discussed, control signals are provided by controller 31 to actuate motor 58 to pivot one of switchplates 54 into alignment behind a selected one of fixed vanes 42, plate 54 and auxiliary line 53 thus serve to selectively extend the obstruction free path along conveyor 18 for signature flaps overlying a selected one of wires 48 to signature support 34. The signatures overlying the selected wire 48 are thus routed over support 34 and ride along the upper edge of support 34. The signature flaps not overlying the selected wire 48, will not be routed over support 34. Rather, they are conveyed in a generally vertical position alongside conveyor 18, as set forth in aforementioned Gruber U.S Pat. No. 4,395,031. Thus, two groups of pages are formed, spaced from each other; the first group of signatures are moved out of superpositioned relationship with respect to the remainder of signatures in the book. The first group, conveyed over support 34, is routed to a guide, plow, table or the like associated with customizing unit 36.

Customization is then effected. The selected signature may be printed from the top and/or bottom and/or supplemented such as by a blow-in card feeder or other suitable insertion device. The outside pages of signatures 16 hanging vertically from the conveyor 18 may also be customized. Alternatively or additionally, a label applying device or the like may be provided to operate on one or more of the exposed signatures. The operation of the printer and/or insertion unit 36 is synchronized with either the motion of the conveyor 18, in a conventional manner, or, more precisely controlled, in accordance with the actual position of the signature 6. The first group is eventually combined together with the second group, conveyed alongside conveyor 18, and the book serially fed to stitcher 22, trimmer 24, labelling station 26 and stacker 28.

As previously stated, customizing system 30 of the present invention is controlled by a programmable computer (CPU) 31 which operates in a manner well known in the art to generally coordinate the various functions of the overall system 10. Examples of controllers of this type are described in Anderson et.al. U.S. Pat. No. 3,819,173, Riley et.al. U.S. Pat. No. 4,121,818, and Gruber U.S. Pat. No. 4,395,031. The control of signature selector 32 is suitably effected as part of the collation process, integrated into the conventional control systems. As in a conventional system, controller 31 monitors the position of the signature 16 being transported on conveyor 18, by for example the lug detector 35 or a conveyor drive encoder. A respective data record, associated with each product (book) to be collated, is accessed, in sequence, from an information source, typically a magnetic tape. In a conventional system such record would include coded information (a product build descriptor) designating the particular feeders to be actuated to build the book (i.e., the particular component signatures of the book); indicia of the identity and address of the subscriber for which the book is being assembled; and customization information, e.g., a particular message to be printed in the book, actuation indicia for a card inserter, or applique device and the like. In system 10, in accordance with the present invention, such customization information would also include a coded designation (signature selection control field) of the signature at which customization is to be effected, e.g., the desired position of plate 54, and, where multiple ink jet heads or devices are employed, the particular heads or devices to be actuated, etc.

Figure 6:
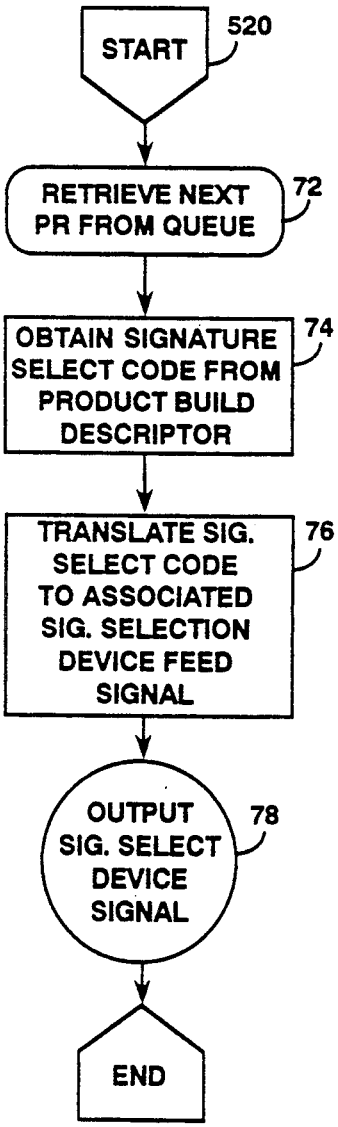
FIG. 6 is a flow chart for the interrupt service routine associated with the signature selection.
Figure 5:
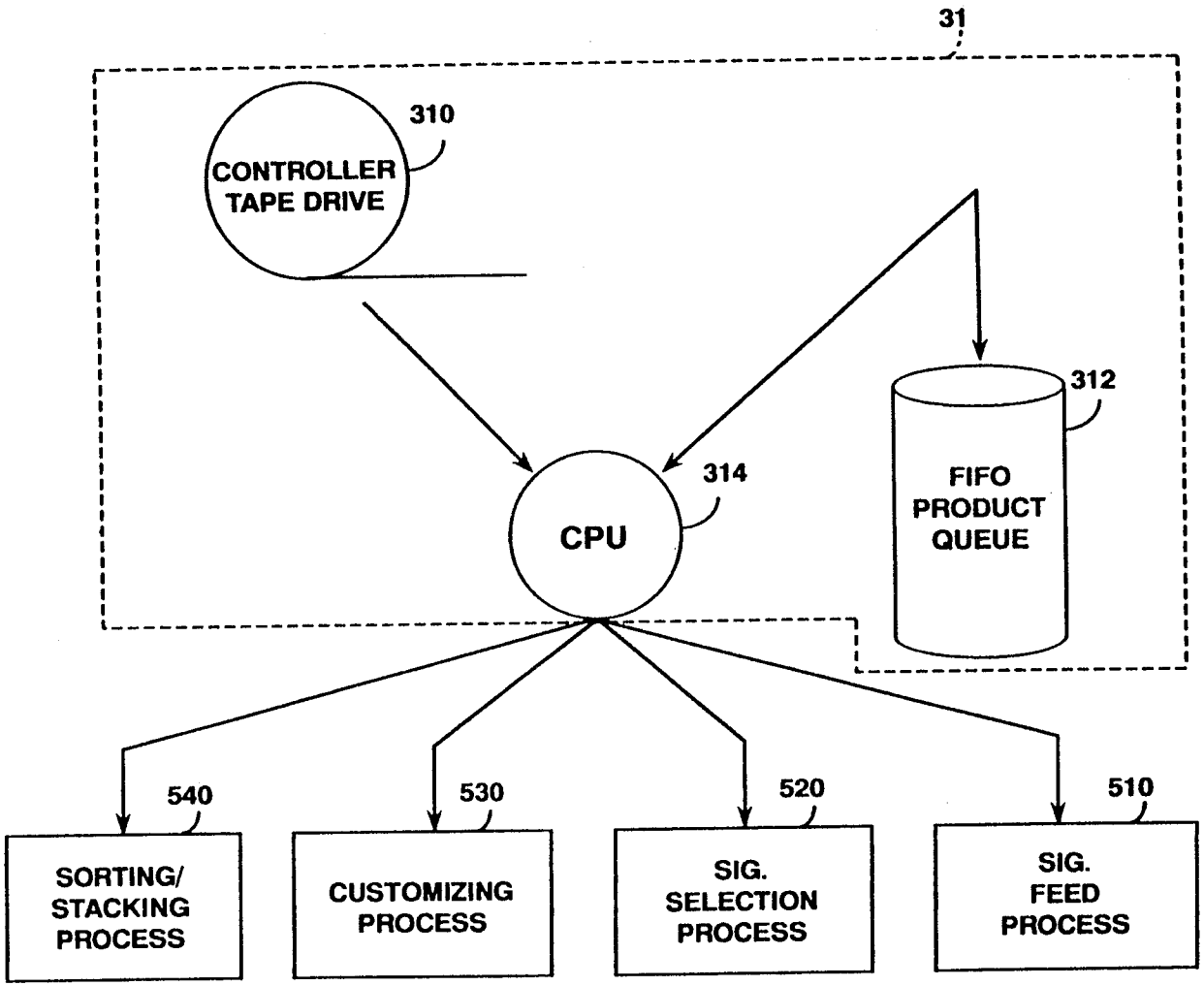
FIG. 5 is a diagram of the computerized control system used with the present invention.

Referring to FIG. 5, product data records are sequentially retrieved from storage, e.g., read from the magnetic tape by tape drive 310 associated with controller 31. Each record is sequenced through a first in first out (FIFO) queue maintained in the random access memory of computer 31. In general, the position of the record in the queue corresponds to the relative position of the associated product along the conveyor line. As a product slot advances along conveyor 18, feeders 14 are selectively actuated in accordance with the product build descriptor contained in the associated record in a conventional manner (represented in the state diagram of FIG. 5 as signature feed process 510). When a given product reaches selection station 32 detector 35 generates an interrupt to controller 31, causing a signature selection service routine 520 to be executed to generate appropriate control signals to motor 58 to position switchplate 54 to align with a vane 42 corresponding to a designated signature (feeder 14). More specifically, referring briefly to FIG. 6, upon initiation of service routine 520, the appropriate product record is retrieved from queue 312 (step 72). The signature select code, i.e., contents of a predetermined signature selection control field within the record is then accessed, e.g., loaded into a designated working register associated with the CPU 314 of controller 31 (step 74). The appropriate control signals for motor 58 to move switchplate 54 into the desired position are then derived (step 76) and output signals generated to motor 58 (step 78). For example, the difference between indicia of the present position of switchplate 54 and the desired position could be determined, and a control signal generated in accordance with such difference. Service routine 520 would be implemented in accordance with conventional techniques, well known in the art.

Referring again to FIG. 5, once a particular signature is selected, the product is presented with the designated signature (and/or adjacent signatures) exposed to customizing unit 36. Customization is then effected in accordance with the customization information in the product record (customization process 530). For example, one or more of the exposed signatures may be imprinted with the contents of a message field in the record. The product is thereafter subjected to sorting and packaged in accordance with associated control fields in the product record (sorting/stacking process 540).

Upon completion of the stacking process, the product record associated with the particular book is removed from the queue 312, and a new product record retrieved from storage through tape drive 310, as placed at the foot of the queue. As should be appreciated, each of various processes 510, 520, 530, and 540 are effected in tandem upon different products at the various positions along conveyor 18.

It should be appreciated the present invention greatly enhances the flexibility of customizing signatures in a collating and binding system and allows substantially different magazines, having different points of customization, to be produced during a single production run corresponding to subscribers in a given postal zone. In addition, gains in operating efficiency are achieved; the need for manual restringing of guide wires, and concomitant down time, is effectively minimized. The preferred form of the invention is adaptable to existing systems as a replacement or improvement unit and continues to offer versatility in design for efficient handling of signature groups of various sizes, weights and finishes.

Unlike prior art systems of generally fixed customizing capability, (location of customizing is fixed for all products in the production run), the present invention provides personalization on a book- by-book basis, both as to location and mode of the specialized message.

While the invention has been described with reference to a preferred embodiment, those skilled in the art will appreciate that certain substitutions, alterations and omissions may be made without departing from the spirit thereof For example, the customizing unit 36 may take on any number of forms such as any manner of printer, inserter, or applique device, and may be further refined with other advancements to improve the quality of the printing applied. In addition, while the preferred form of the invention discloses a switch-plate movable with respect to fixed vanes, such arrangement may be reversed if desired. Accordingly, the foregoing description is meant to be exemplary only and should not be deemed limitative on the scope of the invention set forth in the following claims.

What is claimed is:

1. A signature customizing system of the type including a conveyor, a plurality of feeders for selectively delivering signatures to said conveyor in superpositioned relationship to progressively form books of signatures, selection means adjacent said conveyor for selecting a signature, opening means cooperating with said selection means to open each book of signatures at said selected signature and customizing means adjacent said opening means for applying customized information to said signature when opened, improved wherein said selection means further comprises:

control means, operatively connected with said conveyor, for controllably selecting said signature, on a book-by-book basis; and a plurality of vanes, said vanes having elongated guide members secured thereto and extending o various locations on said feeders, s switchplate in communication with said opening means, said switchplate being alignable with said vanes and copperable with said guide members to select a customizing location for each book of signatures in accordance with said control means.

2. The system of claim 1, wherein said vanes extend parallel to one another and to said conveyor and one grouped in banks spaced equidistant from said conveyor.

3. The system of claim 1, wherein said switchplate is movable with respect to said vanes and defines a path of extended travel for said selected signature when said switchplate is aligned with one of said vanes.

4. The system of claim 1, wherein said switchplate is pivotably mounted upon a shaft of a motor operable in accordance with said control means.

5. A signature customizing system of the type including a conveyor, a plurality of feeders for delivering signatures to said conveyor in superpositioned relationship to progressively form demographic books of signatures, selection means adjacent said conveyor for selecting a signature from one of said feeders, opening means cooperating with said selection means for opening each book of signatures at said selected signature and customizing means adjacent said opening means for applying customized information to said signature when opened, the system including:

first means adjacent said conveyor for communicating with said selection means;

second means adjacent said conveyor for communicating with said opening means;

said first and second means being selectively alignable with each other to controllably define a path over which said selected signature is deliverable to said customizing means; and one of said first means and said second means being movable and the other of said first means and said second means being fixed.

6. The system of claim 5, further including control means responsive, to an information source remote from said conveyor for directing the movement of said first means relative to said second means.

7. The system of claim 5, further including motor means, adjacent the conveyor, for selectively aligning said first means and said second means in accordance with the position of each book of signatures formed on said conveyor.

8. The system of claim 5, said selection means being able to select a signature from any of said feeders without substantially interrupting the motion of said conveyor.

9. The system of claim 9, wherein said customizing means comprises a contactless printer.

10. A system for collating signatures, said system being of the type including:

a controller, cooperating with a source of subscriber information, for generating control signals in accordance with said subscribed information;

a conveyor;

a plurality of feeders for, responsive to control signals from said controller indicative of particular individual signatures, delivering said particular individual signatures to said conveyor to progressively form respective groups of signatures in superimposed relationship;

customization means for effecting a customizing operation on a signature exposed thereto; and means for moving a signature in each of said groups out of superimposed relationship to expose a signature to said customization means;

said system improved wherein:

said controller includes means for generating, with respect to individual ones of said respective groups of signatures, signals designating one of the particular individual signatures in said group; and said means for moving comprises means, responsive to said signals designating one of said signatures, for controllably moving said designated signature out of superimposed relationship to expose a signature to said customizing means in the form of a plurality of guides, each guide being associated with a respective associated individual one of said feeders and disposed to receive signatures delivered to said conveyor from said associated feeder such that said signatures ride on said guide as said signature travels on said conveyor;

a switchplate interposed between said guides and said customization means, movably disposed to selectively couple said customization means to a respective one of said guides such that the signature riding on said guide is exposed to said customization means; and means, responsive to said signals designating one of said signatures, for controllably moving said switchplate to couple said customization means to the guide associated with said designated signature.

11. The system of claim 10 wherein said guides comprise:

an elongated member disposed extending along said conveyor from a point in proximity to said associated feeder; and a vane associated with said elongated member disposed to selectively align with said switchplate.

* * * * *